US005238201A

United States Patent [19]

Jonushaitis

[11] Patent Number: 5,238,201

[45] Date of Patent: Aug. 24, 1993

[54] HAND-HELD LINE REEL WITH BRAKE

[76] Inventor: Allen E. Jonushaitis, 37 Calhoun Ter., San Francisco, Calif. 94133

[21] Appl. No.: 808,581

[22] Filed: Dec. 17, 1991

[51] Int. Cl.[5] ..... B65H 75/40

[52] U.S. Cl. ..... 242/96; 242/99

[58] Field of Search ..... 242/96, 99, 303

[56] References Cited

U.S. PATENT DOCUMENTS

| | | | |
|---|---|---|---|
| 1,353,113 | 9/1920 | Deets | 242/303 X |
| 2,249,433 | 7/1941 | Palmer | 242/99 |
| 2,656,993 | 10/1953 | Dukes | 242/303 X |
| 2,753,131 | 7/1956 | Erdman | 242/99 |
| 2,961,184 | 11/1960 | Alford | 242/96 |
| 3,040,463 | 6/1962 | Levey | 242/303 X |
| 3,044,732 | 7/1962 | Simonds | 242/96 |
| 3,072,356 | 1/1963 | Leuthner | 242/303 X |
| 3,090,577 | 5/1963 | Lewandowski | 242/99 |
| 3,434,676 | 3/1969 | Bogue | 242/303 |
| 3,591,107 | 7/1971 | Ferguson | 242/303 X |
| 3,705,697 | 12/1972 | Chagnon | 242/96 X |
| 3,731,887 | 5/1973 | Wheeler | 242/96 |
| 3,830,443 | 8/1974 | Quenot | 242/96 X |
| 3,838,830 | 10/1974 | Pettit | 242/96 |
| 4,106,719 | 8/1978 | Haverland | 242/96 |
| 4,111,387 | 9/1978 | Leary | 242/96 X |
| 4,129,273 | 12/1978 | Hill | 242/96 X |
| 4,176,807 | 12/1979 | Kwon | 242/96 |
| 4,204,651 | 5/1980 | Haverland | 242/96 |
| 4,442,983 | 4/1984 | Moll | 242/99 X |
| 4,747,561 | 5/1988 | Sweeny et al. | 242/96 |
| 4,756,486 | 7/1988 | Campbell | 242/96 X |
| 4,773,612 | 9/1988 | Futrell, II | 242/99 |
| 4,796,827 | 1/1989 | Munt, III et al. | 242/96 |
| 4,821,976 | 4/1989 | Nakashima | 242/96 |
| 4,936,079 | 6/1990 | Skalsky et al. | 242/68.7 X |
| 4,946,115 | 8/1990 | Müller | 242/303 X |

*Primary Examiner*—Daniel P. Stodola
*Assistant Examiner*—John P. Darling
*Attorney, Agent, or Firm*—Thomas C. Saitta

[57] ABSTRACT

A mobile hand-held apparatus for feedout, and uptake of a line comprising a base member (10), an axle (12) extending from the base member, a spool (14) rotably mounted on the axle, a spool retainer (13), a line retainer (20), a brake lever (16) mounted on and threadably engaging the axle (12), and a brake lever movement limiting projection (18). The brake lever (16) can be operated by the same hand that holds the reel. The brake lever (16) is threadably mounted on the axle (12) next to the spool (14) and when the brake lever is moved through a braking stroke the lever and spool move along the axle increasing friction between the brake lever (16) and the spool (14) and between the spool (14) and a fixed element of the reel.

20 Claims, 5 Drawing Sheets

HAND-HELD LINE REEL WITH BRAKE

TECHNICAL FIELD

This invention is generally related to a mobile, hand-held reel for the uptake and feedout of a line, more particularly to such a reel with a brake.

DESCRIPTION OF RELATED ART

U.S. Pat. Nos. 4,204,651 and 4,106,719, both to Haverland, both refer to a reel assembly with a moving spool, a crank on one side and a braking means on the opposite side. U.S. Pat. No. 4,129,273 to Hill refers to a kite control mechanism which includes a pair of spools and a manually operable lock device. U.S. Pat. No. 3,090,577 refers to a line reel with a brake mechanism. None of these patents describes a reel with a braking device which is at all similar to the apparatus disclosed in the subject invention or which meets the objectives of this invention.

U.S. Pat. No. 4,756,486 refers to a scuba diving reel with a spool and a pinch mechanism for maintaining a taut line. U.S. Pat. No. 3,705,697 refers to a scuba diving reel which straps to the forearm of a diver and has a wedging means to fix the unwound line at a particular length. Neither of these patents disclose a reel which has a mechanism similar to that disclosed in the instant invention. Furthermore, the apparatus of the subject invention has several advantages. There are no parts, such as set screws, which might loosen and fall off. One hand operation is possible. The simple design offers little possibility of snagging or bending the reel during operation.

SUMMARY OF THE INVENTION

Various situations involving feedout and uptake of a line, require controlling the speed of feedout, preventing the unwanted run-off of line due to excess spool rotation, and, once the desired length of line is fed out, fully securing the line to prevent additional feedout even when tension is applied to the line. Some of the activities in which this controlled feedout and uptake of line may be required include, but are not limited to, scuba diving and cave diving, kite flying, fishing and trolling, mountaineering, sailing, and the like. In many applications it is important to be able to control the uptake and feedout of line with one hand. Particularly, it is useful to be able to completely secure the feedout of a tethered line with one hand, even when the line is under tension.

It is an object of this invention to provide a mobile hand-held reel for the uptake and feedout of a line.

It is an object of this invention to provide a reel which can control rate of line feedout and uptake.

It is an object of this invention to provide a reel which can prevent line run-on.

It is an object of this invention to provide for the braking and securing of line feedout even when under tension.

It is an object of this invention to be able to provide for the control and securing of line with the same hand that holds the mobile reel.

It is an object of this invention to provide a reel suitable for cave diving.

The objects of this invention are achieved by a mobile hand-held apparatus for feedout, and uptake of a line. The reel has a base member and it has an axle with a secured end attached to the base member and extending from the base member. The axle also has a threaded portion proximal to one of the ends. A spool is rotably mounted on the axle. The spool is retained on the axle by a spool retainer positioned proximal to the free end of the axle. The reel has a line retainer and a brake lever. The brake lever has a mounted end threadably engaging a threaded portion of the axle, thereby providing for the movement of the lever around the axle, and an operating arm extending from the mounted end generally perpendicular to the axle and terminating at a free end. The reel has brake lever movement limiting means. The brake lever can be moved through a braking stroke to a braking position which displaces the lever and the spool along the axle, thereby producing frictional inhibition of spool rotation. The brake lever can also be moved through a releasing stroke to a free position which displaces the lever away from the spool permitting spool rotation.

DETAILED DESCRIPTION

Figure 1:
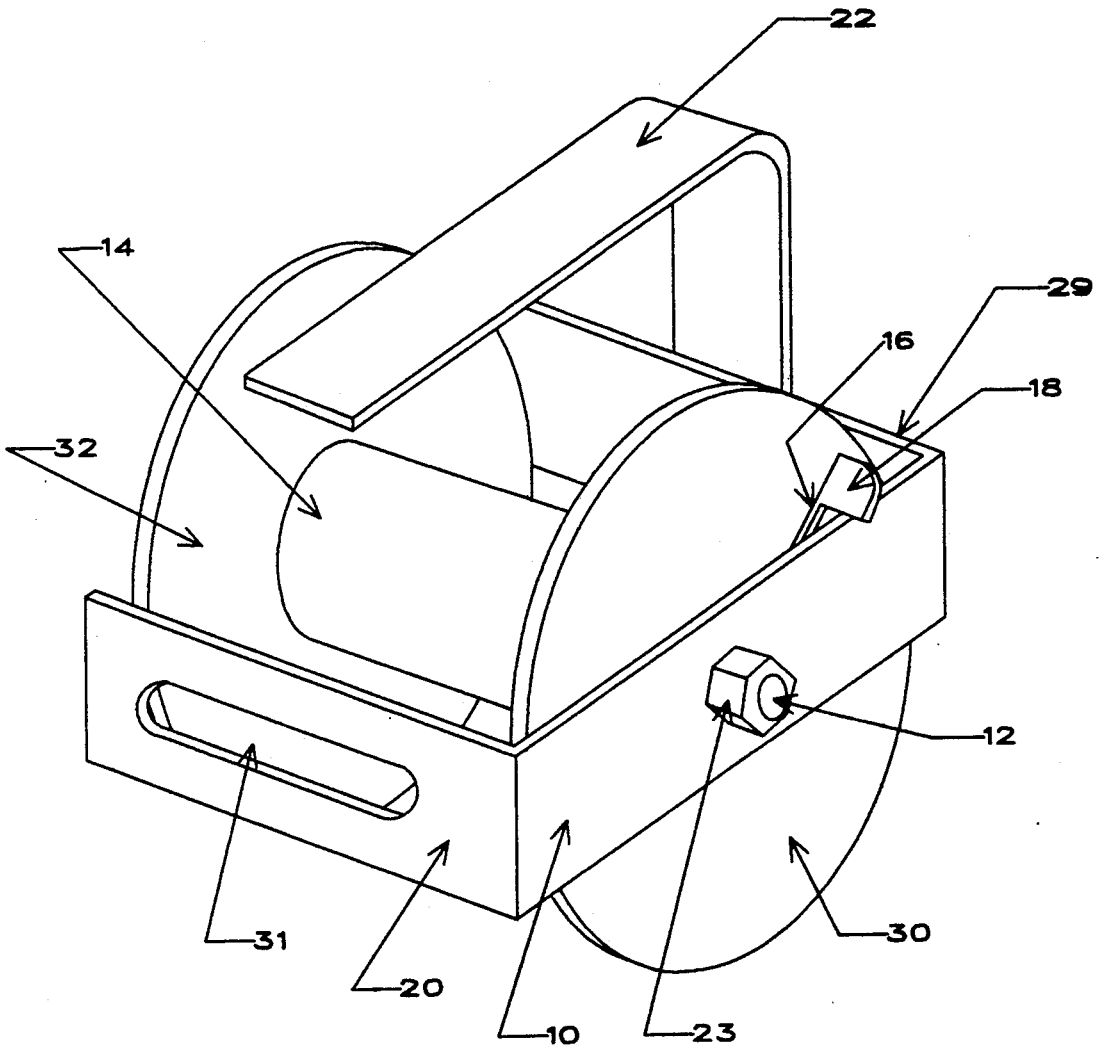
FIG. 1 is a perspective view of the hand held line reel with line guide and handle.
Figure 2:
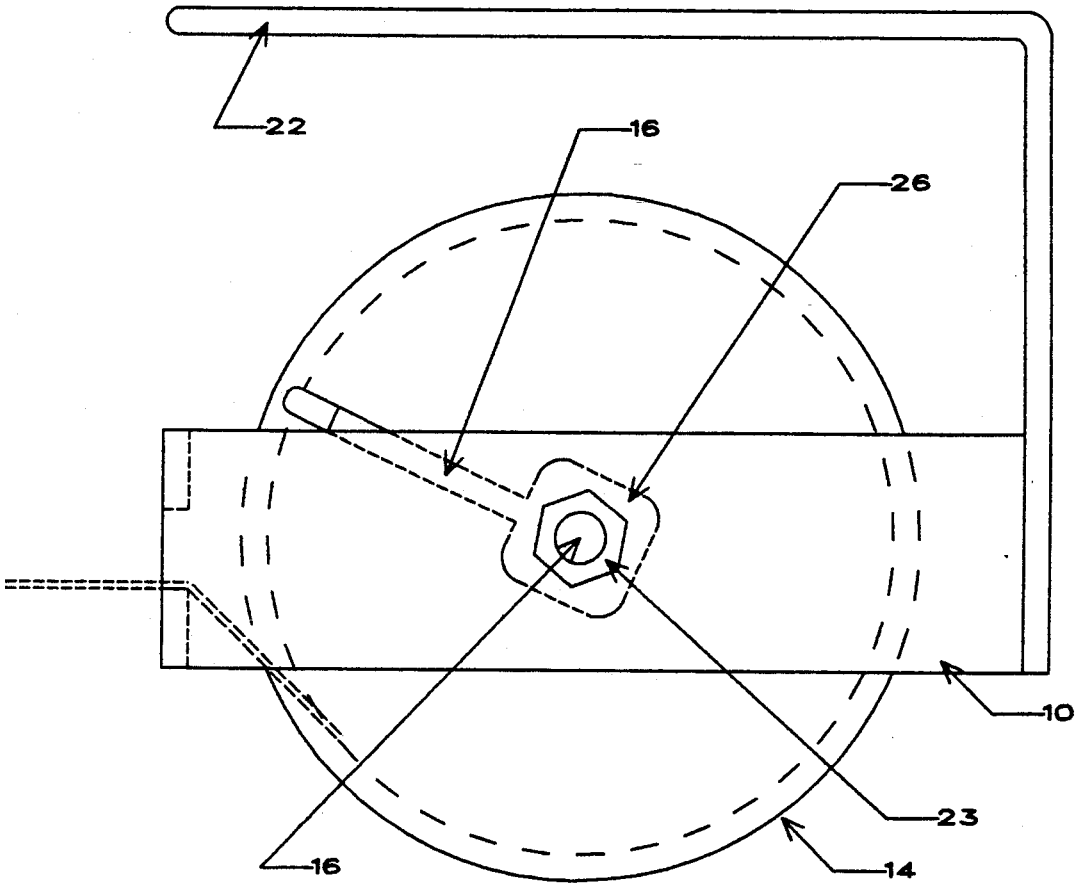
FIG. 2 is a side view of the hand held line reel.
Figure 3:
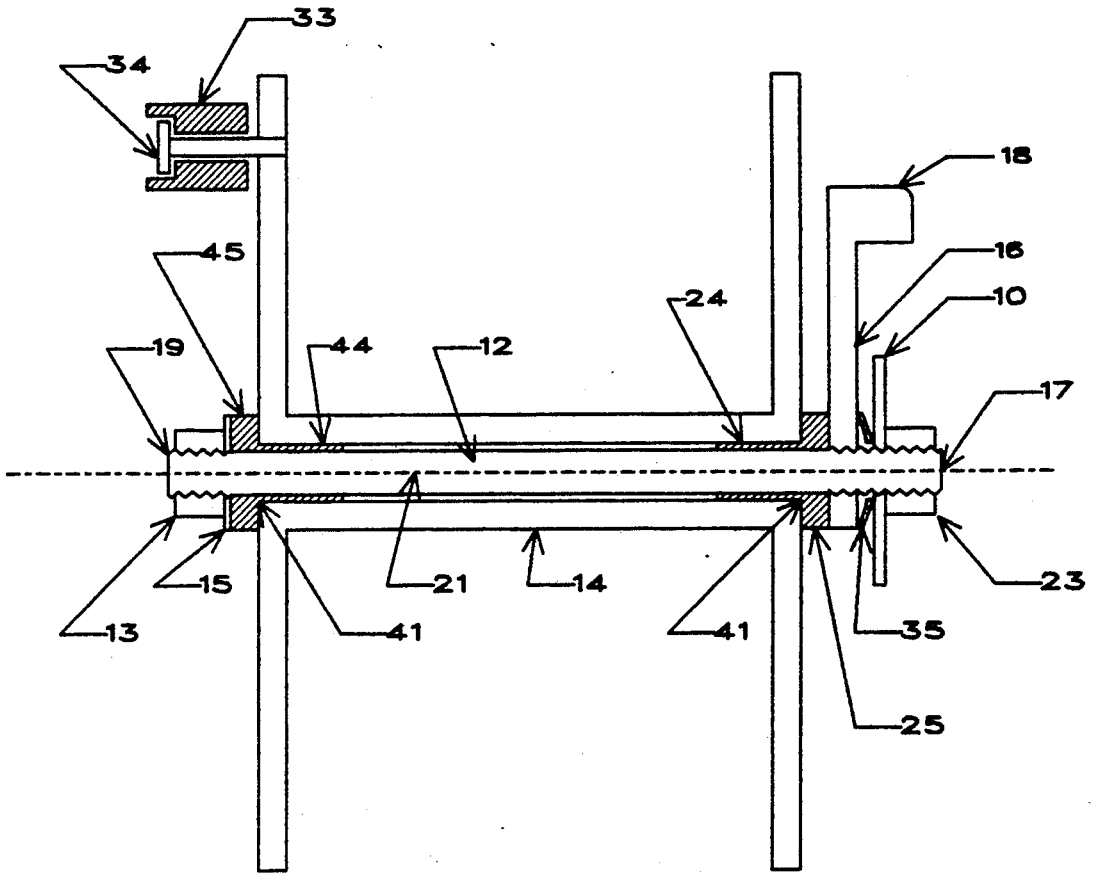
FIG. 3 is a sectional view of the hand held line reel.

The mobile, hand-held apparatus of the present invention is a reel which has a base-member 10, and axle 12, spool means 14, spool retaining means 13, a brake lever 16, and brake lever movement limiting means 18. The axle 12 is secured to the base-member 10 either permanently, for example by welding, casting, molding or the like, or removably by inserting a threaded secured end 17 of the axle in an aperture in the base-member 10, and threadably engaging the base member, or alternatively, threadably engaging a securing nut 23 on the protruding axle. A removable axle secured by threadably engaging a nut 23 is a preferred mode.

The spool means may be one or more spool drums 14 which are cylinders rotably mountable on the axle 12 and upon which line can be wound. The embodiment of FIG. 1 shows a single spool having a first side 30 facing the base member with a first aperture 21 located generally central on the first side 30, and a second side 32 facing the spool retaining means with a second aperture 41 located generally central on the second side 32. The spool is rotably mounted on the axle which passes through the first and second apertures 21 and 41. The axle 12 is along the central axis of the spool 14. The spool is retained on the axle by the spool retaining means 13 positioned at the free end 19 of the axle 12. The spool retaining means 13 may be any suitable restraining structure at or near the free end 19 of the axle for holding the spool 14 on the axle 12, such as a pin, an enlarged end produced by welding, casting, forming or the like. In the embodiment of FIG. 1 the spool retaining means 13 is a removable retaining nut threadably engaged on the threaded free end 19 of the axle, more preferably with a washer 15 proximal to the retaining nut 13 and distal to the free end of the axle 19.

Figure 4:
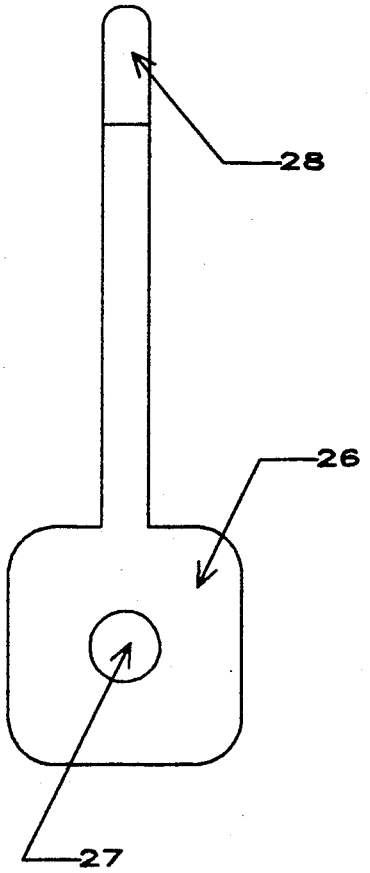
FIG. 4 is a side view of the brake lever of the hand held line reel.
Figure 6:
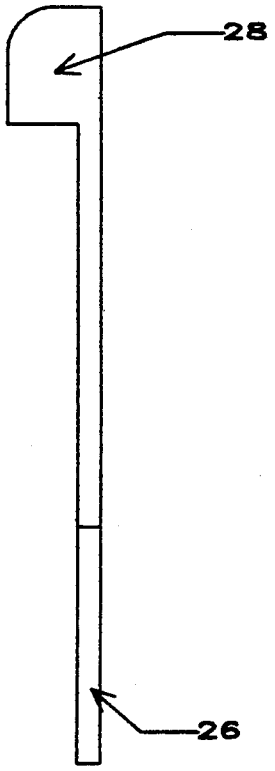
FIG. 6 is a frontal view of the brake lever.
Figure 5:
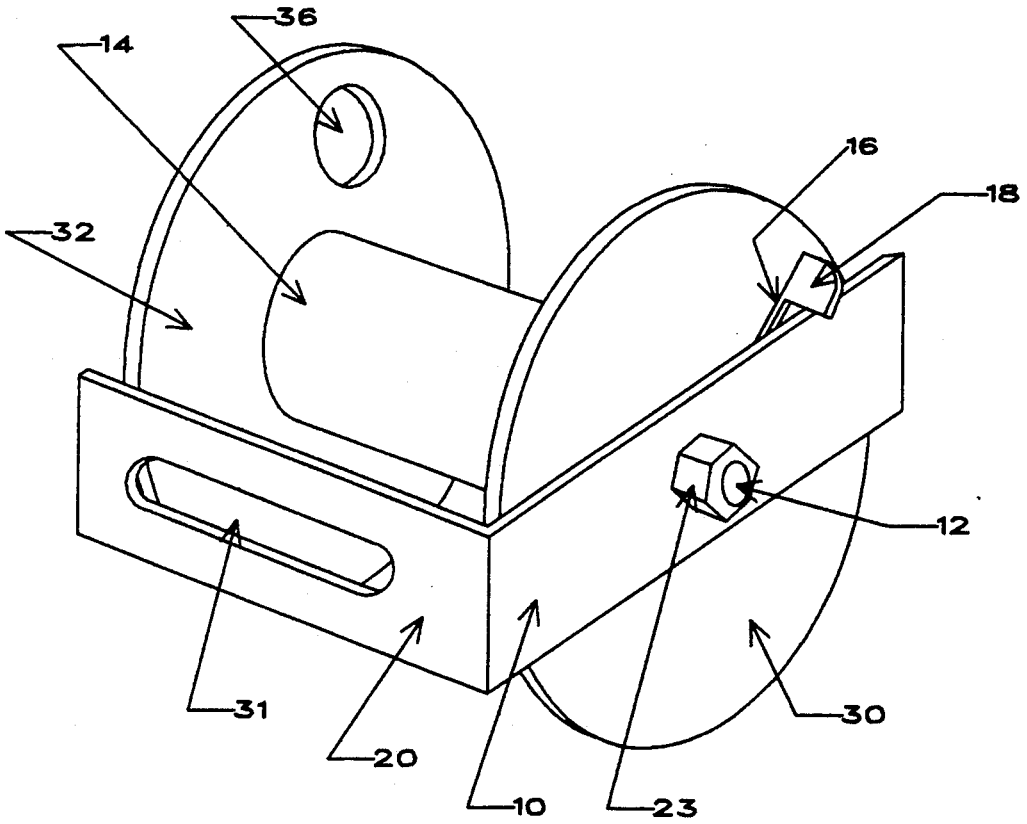
FIG. 5 is a perspective view of the hand held jump reel with line guide and spool rotating indentation.

The brake lever 16 is mounted on the axle by threadably engaging the threaded aperture 27 in the mounted end 26 of the brake lever with the threaded portion 11 of the axle which is proximal to an end of the axle. The spool 14 is positioned immediately proximal to the brake lever 16. The lever may be positioned between the spool 14 and the spool retaining means 13, or in a preferred embodiment the lever is positioned between the spool 14 and the base member 10. As shown in FIG. 4, the mounted end 26 of the brake lever may be wider than the rest of the brake lever 16 in order to provide more of a frictional braking surface to the spool 14. As described infra, moving the brake lever 16 through a braking stroke will move the brake lever 16 and spool 14 along the axle 12 creating frictional inhibition of spool rotation.

The close contact between the mounted end of the braking lever 26 and spool 14 on one side, and on the other side, between the spool 14 and either the base member 10 or, in a preferred embodiment, the spool retaining means 13 is a desirable feature of the subject invention.

The movement of the brake lever 16 is limited by movement limiting means which keep the brake lever from rotating more than 180°, preferably between 45° and 135°, more preferably between 60° and 120°. In one embodiment the movement limiting means are projections of the base member extending generally perpendicular across the path of the brake lever stroke which limit the movement by abutting upon the lever. The function of these projections may be provided by the line guide 20 and back portion 29 of the base member if present. In a preferred embodiment movement limiting means is a single projection 18 extending generally perpendicular from the brake lever 16 above the base member 10 for abutting upon the base member as the brake lever is moved through its braking and releasing stroke. In a more preferred embodiment the projection 18 is a tab at the free end 28 of the operating arm of the brake lever 16 and also facilitates moving the brake lever through a braking or releasing stroke by the thumb of an operator.

In a preferred embodiment, tensioning means is provided to keep the brake lever 16 from inadvertently moving or slipping from the free or released position to the braking position. Preferably, tensioning means is a spring washer 35 located around the axle between the mounted end of the brake lever 16 and the base member 10. The spring washer 35 provides frictional tension on the brake lever 16, thereby preventing slippage.

In a preferred embodiment, the spool 14 is rotably mounted on the axle 12 by means of a first bushing 24 positioned in the first aperture 21 located generally central on the first side 30 of the spool and a second bushing 44 positioned in the second aperture 41 located generally central on the second side 32 of the spool. In a more preferred embodiment the first and second bushing have flange portions 25 and 45 which are external and proximal to each spool side 30 and 32. These flanges provide a frictional braking surface between the spool 14 and brake lever 16, and between the spool and either the spool retaining means 13 or the base member 10. In a preferred embodiment the bushings 24 and 44, including the flanges 25 and 45 are made of a nylon material.

The reel has line retaining means 20. The line passes through line retaining means and, when tension is on the line, line retaining means prevent the line from slipping off the spool. In the embodiment shown in FIG. 1 the line retaining means is a line guide that extends from the base member 10, across the face of the spool, parallel to the axle and proximal to the outer perimeter of the sides of the spool. The line guide 20 has an aperture 31 through which the line passes. The face of the spool is the operating direction of the spool from which the line is fed out and taken up. More preferably, the line guide and base member are produced as a single piece of material either by casting, molding or bending as appropriate for the material. The line guide also helps to keep the line on the spool during uptake. The height of the aperture should be adequate to permit the unrestricted uptake and feedout of line. The width of the aperture is about centered between the two sides 30 and 32 of the spool and ranges from about the distance between the two sides of the spool to about ⅔ of the distance between the two sides.

The reel may have spool rotating means for facilitating the rotation of the spool 14 during uptake of line. Spool rotating means may be an integral part of the design of the spool, such as serrations or scallops in the perimeter of sides 30 of the spool. Preferably, spool rotating means may be an approximately finger-sized hole or indentation 36 eccentrically located on the external side of the spool side 32 distal to the base member 10. More preferably, spool rotating means may be a knob 33 eccentrically located on the external side of the spool side 32 distal to the base member 10. To facilitate turning, the knob may be rotably mounted on a peg 34 attached to the spool side 32. Other methods of facilitating spool rotation will be readily apparent to one skilled in the art.

The base member of the reel may optionally have a back portion 29. The back member may be part of a single piece containing the base member 10 and line guide 20. The reel may optionally have a handle 22 extending from the base member 10 or the back portion of the base member 29. The handle provides a means for holding the reel during operation. In a preferred embodiment, the handle is positioned to facilitate holding the reel and operating the brake lever 16 with the same hand. In a more preferred embodiment, the handle 22 extends from the base member 10 by way of attachment to the back portion 29 of the base member such that the long axis of the handle is perpendicular to the axle 12 and spatially positioned above the spool 14 such that the operating end 18 of the brake lever is proximate to the handle 22 throughout the movement of the brake lever 16.

Material

The base member and the axle may be made of any rigid material such metal or plastic, preferably aluminum or steel, more preferably stainless steel. The base member and axle need not be made of the same material. The spool may be made of any rigid material such as metal or plastic, preferably aluminum, steel or plastic, more preferably acrylic. If the apparatus is likely to be exposed to alcohols, polycarbonate may be less desirable do to its susceptibility to alcohol corrosion.

The securing nut 23 and retaining nut 13 are preferably self-locking nuts. These nuts as well as the brake lever 16 can be made of metal or plastic, preferably stainless steel, brass, aluminum or the like. Preferably they are made of the same material as the axle 12.

The bushings can be made of a metal such as stainless steel or brass or the like, or preferably they can be made of a synthetic material. A nylon material is preferred because nylon has limited compressibility and is self-lubricating in water.

The line guide 20 is preferably made of the same material as the base member 10 and more preferably are formed from a single element by molding, casting, bending or the like, as appropriate for the type of material.

The handle 22, if present, may also be made from the same material as the base member 10, or may be made from a buoyant thermoplastic formed to provide a hand grip. The overall buoyancy of the apparatus can be established by the amount and volume of buoyant material used in constructing the apparatus

OPERATION

The present invention is useful for controlled feedout and uptake of line. A "line" is a rope, cord, string, twine, wire, cable, yarn or the like and may be made out of any natural or synthetic fiber, filament or flexible metal. Preferably the line is made of nylon or polyester. The line may be any thickness, but of course thicker line will require a larger spool depending on the length of line required to be held on the spool. The diameter of the line will be from at least about 1/32 inch to about ½ inch, preferably from at least about 3/32 inch to about ¼ inch.

The reel may be operated with a tethered line, a free line, or a line attached to a mobile object. First, the line is wound onto the spool 14 by attaching the line to the spool and then rotating the spool to take up the line. The line is first passed through the aperture 31 in the line guide 20 before winding it onto the spool. If winding means are provided these are used to facilitate rotation of the spool. During the uptake of the line the brake lever 16 is moved to the extreme of the stroke, moving the threaded brake lever 16 along the axle 12 away from the spool 14. This releasing stroke creates the minimum amount of friction on the spool 14. The direction of winding of the line on the spool should be such that the spool rotates in the direction which would tend to increase the frictional force of the brake lever when the line is fed out from the reel. Thus, if the braking stroke of the brake lever 16 is clockwise, then the spool 14 would rotate clockwise when the line is fed out.

As required, the line may be fed out from the reel alternatively by pulling on the line, by gravity (if a weight is attached to the line), or if the line is tethered, by holding the reel and moving away from the tethered end of the line. If the spool 14 spins faster than desired the rotation of the spool may be retarded by moving the threaded brake lever 16 in the direction opposite from the releasing stroke. This moves the lever 16 and spool 14 along the axle toward the spool retaining nut 13. This braking stroke increases friction on the spool either directly or through the flanged portions 25 and 45 of the spool bushings 24 and 44, and retards the rotation of the spool. In an alternate configuration the brake lever 16 is proximal to the spool retaining means 13 and the braking stroke moves the lever 16 and the spool 14 toward the base member 10.

Once the desired length of line is fed out, the brake lever 16 is moved to the extreme of the braking stroke, creating enough friction to fully secure to line on the spool 14 such that no more line will be fed out even when the line is under tension. The travel distance of the brake lever 16 along the axle 12 should cause a minimum of friction at the extreme of the releasing stroke while assuring enough friction at the extreme of the braking stroke to fully secure the spool 14 but not create an irreversible bind between the brake lever 16 and the spool. It will be understood by one skilled in the art that the distance of travel of the brake lever along the axle will determine the amount of frictional resistance generated. This in turn will depend upon whether bushing flanges are used, and the coefficient of friction and compressibility of the material used, For nylon bushing flanges, it is desirable to choose a thread lead on the threaded portion 11 of the axle to which the brake lever 16 is threadably engaged such that movement of the brake lever through a full braking stroke provides at least 0.012" but not more than 0.020" of travel of the brake lever along the axle 12. A travel of at least 0.015" to but no more than 0.017" is preferred.

When the brake is applied, it is desirable for the brake to remain secured until pressure is exerted to release the brake. This can be achieved by choosing a thread pitch on the threaded portion of the axle to which the brake lever is threadably engaged such that the angle of the thread to the axis of the axle is less than about 30° relative to a line perpendicular to the axle. This thread pitch prevents undesired slippage of the brake.

Cave Diving Reels

Certain embodiments of the subject invention are particularly useful in scuba diving, more particularly in cave and cavern diving. In cave diving, a safety line carried on a suitable, lightweight reel is an essential piece of equipment. Securing the line at the entrance of the cave and paying out the tethered line as the cave is entered provides a physical guide to the route of exit from the cave. Since mobility and visibility are limited in cave diving, it is important to have a reel which, with one hand, can easily control the feedout of the line, can prevent the run-off of line once the feedout is terminated and can secure the line on the reel to prevent excess line from unrolling. It is also useful to have a reel which has a buoyancy which is neutral or slightly negative because a diver's most effective field of operation while swimming is below and to the side of his upper body. Consequently, neutral to slightly negative buoyancy would enables the diver to quickly recover the reel if it is dropped.

In an embodiment of the invention, the apparatus described above is submersible for use underwater. All elements are made of materials which do not corrode in salt-water. Preferably, the apparatus has a buoyancy in water that is no greater than neutral such that, if the reel is dropped underwater it will not tend to rise. Preferably the buoyancy of the reel will be near neutral.

Reels of various sizes and with various optional elements will have different specific applications in cave diving. For instance, an "exploration reel" will hold at least one thousand feet of line. This reel has a handle and a line guide. The spool is at least about 5 inches, preferably at least about 6 inches in diameter and at least about 6 inches, preferably about 12 inches in width. A "main reel" will hold 200 to 700 feet, preferably 300 to 500 feet of line. This reel also has a handle and line guide. The spool is at least about 3 inches but no more than about 8 inches in diameter and at least about 1.5 inches but no more than about 4 inches in width. An "safety reel" will hold 100 to 300 feet, preferably 150 to 200 feet of line. This reel has a line guide and may or may not have a handle. The spool is at least about 2 inches but no more than about 4 inches in diameter and at least about 1.5 inches but no more than about 3 inches in width. Finally, a "jump reel" will hold less than 100 feet of line. The reel does has a line guide but no handle. The spool is at least about 2 inches but no greater than about 4 inches in diameter and at least about 0.75 inches but no greater than about 1.5 inches in width.

It will be apparent to those skilled in the art that the objects of this invention have been achieved by providing the embodiments described herein. Various changes may be made in the structure and embodiments shown herein without departing from the concept of the invention. Further, features of the embodiments shown in the various Figures may be employed with the embodiments of the other Figures. Therefore, the scope of the invention is to be determined by the terminology of the following claims and the legal equivalents thereof.

I claim as my invention:

1. A mobile hand-held apparatus for feedout and uptake of a line, said apparatus comprising:

a base member;

an axle having a secured end attached to the base member, a free end distal to the base member, and a threaded portion proximal to one of the ends;

spool means rotatably mounted on the axle, for holding the line;

spool retaining means positioned proximal to the free end of the axle;

line retaining means;

a brake lever having a mounted end threadably engaging the threaded portion of the axle, thereby providing lever movement around the axle, and having an operating arm extending from the mounted end, generally perpendicular to the axle, and terminating at a free end;

the brake lever being positionable in a braking position that displaces the lever and the spool means along the axle and against the spool retaining means or the base member thereby inhibiting spool means rotation;

the brake lever also being positionable in a free position that displaces the lever away from the spool means, thereby permitting spool means rotation; and brake lever movement limiting means comprising one or more projections extending from one of the operating arm and the base member, whereby the brake lever movement around the axle is limited to a rotation of less than 180 degrees by the base member.

2. The apparatus of claim 1 wherein the angle of the thread of the threaded portion of the axle is less than 30° relative to a line perpendicular to the axle.

3. The apparatus of claim 1 wherein the spool means is a spool having a first side proximal to the base member with a first aperture located generally central on the first side, and a second side proximal to the spool retaining means with a second aperture located generally central on the second side.

4. The apparatus of claim 3 further comprising a first and second bushing, the first bushing positioned in the first aperture and the second bushing positioned in the second aperture, and the first and second bushings are concentric with the axle.

5. The apparatus of claim 4 wherein the brake lever is located between the base member and the spool.

6. The apparatus of claim 5 wherein the operating arm of the brake lever extends beyond the base member.

7. The apparatus of claim 5 wherein the first and second bushings further comprise a flange portion external to the spool and proximal to the sides of the spool, such that the flange portion of the first bushing provides a friction surface between the brake lever and the spool, and the flange portion of the second bushing provides a friction surface between the spool retaining means and the spool.

8. The apparatus of claim 7 wherein the first and second bushings are made of nylon.

9. The apparatus of claim 7 further comprising a spring washer located around the axle between the brake lever and the base member.

10. The apparatus of claim 3 wherein the line retaining means is a line guide extending from the base member parallel to the axle and proximal to the perimeters of the first and second sides of the spool and having an aperture through which the line passes.

11. The apparatus of claim 3 wherein the spool retaining means is a removable nut threadably engaging the free end of the axle.

12. The apparatus of claim 3 wherein the axle is removable.

13. The apparatus of claim 12 wherein the axle is threadably attached to the base member.

14. The apparatus of claim 12 wherein the base member further comprises an aperture and the secured end of the axle passes through the aperture and the axle is secured to the base member by a nut threadably attached to the secured end of the axle.

15. The apparatus of claim 3 further comprising spool rotating means.

16. The apparatus of claim 15 wherein the spool rotating means is a rotable knob mounted eccentrically on the second side of the spool.

17. The apparatus of claim 1 wherein the brake lever movement-limiting means is an integral part of the brake lever.

18. The apparatus of claim 1 further comprising a handle extending from the base member said handle having a long axis perpendicular to the axle and said handle spatially positioned above the spool proximate to the free end of the operating arm of the brake lever.

19. The apparatus of claim 1 wherein the apparatus is made of materials which do not corrode in salt-water.

20. The apparatus of claim 19 wherein said apparatus has a buoyancy in water that is no greater than neutral.

* * * * *